US008385583B2

(12) United States Patent
Thompson

(10) Patent No.: US 8,385,583 B2
(45) Date of Patent: Feb. 26, 2013

(54) METHODS AND APPARATUS FOR REDUCED DISTORTION BALANCED ARMATURE DEVICES

(75) Inventor: Stephen C. Thompson, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 769 days.

(21) Appl. No.: 12/549,493

(22) Filed: Aug. 28, 2009

(65) Prior Publication Data

US 2010/0054509 A1 Mar. 4, 2010

Related U.S. Application Data

(60) Provisional application No. 61/092,822, filed on Aug. 29, 2008.

(51) Int. Cl.
*H04R 1/00* (2006.01)

(52) U.S. Cl. ..... 381/418; 381/412; 381/414; 310/12.26; 335/236

(58) Field of Classification Search ..... 381/417–418, 381/412, 414; 335/236; 336/212, 214; 310/12.26
See application file for complete search history.

(56) References Cited

U.S. PATENT DOCUMENTS

| | | | | |
|---|---|---|---|---|
| 1,607,587 A | | 11/1926 | Engholm | |
| 3,002,058 A | * | 9/1961 | Knowles | 381/411 |
| 3,172,022 A | * | 3/1965 | Tibbetts | 335/231 |
| 3,617,653 A | * | 11/1971 | Tibbetts et al. | 310/36 |
| 3,766,332 A | * | 10/1973 | Carlson et al. | 381/418 |
| 3,919,500 A | | 11/1975 | Dymoke-Bradshaw | |
| 3,935,398 A | * | 1/1976 | Carlson et al. | 381/386 |
| 4,000,381 A | | 12/1976 | Plice et al. | |
| 4,272,654 A | | 6/1981 | Carlson | |
| 4,956,868 A | | 9/1990 | Carlson | |
| 5,299,176 A | | 3/1994 | Tibbetts | |
| 5,647,013 A | | 7/1997 | Salvage et al. | |
| 5,701,043 A | | 12/1997 | Razzaghi | |
| 6,526,153 B2 | * | 2/2003 | Tibbetts et al. | 381/412 |
| 6,751,334 B2 | | 6/2004 | Hakansson | |

(Continued)

FOREIGN PATENT DOCUMENTS

| | | |
|---|---|---|
| EP | 094992 A1 | 11/1983 |
| GB | 892918 A | 4/1962 |

(Continued)

OTHER PUBLICATIONS

Stephen C. Thompson, Janice L. LoPresti, Eugene M. Ring, Henry G. Nepomuceno, John J. Beard, William J. Ballad, Elmer V. Carlson, "Noise in miniature microphones," *J. Acoust. Soc. Am.*, 111(2), Feb. 2002, pp. 861-866.

(Continued)

*Primary Examiner* — Curtis Kuntz
*Assistant Examiner* — Ryan Robinson
(74) *Attorney, Agent, or Firm* — Gifford, Krass, Sprinkle, Anderson & Citkowski, P.C.; Douglas L. Wathen

(57) ABSTRACT

An example apparatus comprises a drive coil energizable by a drive signal, at least one permanent magnet, and at least one magnetic return path element for flux induced by the drive signal, the magnetic return path element, such as a balanced armature, being configured to provide a variable reluctance, so as to reduce nonlinearities in a displacement versus drive signal relationship. Modifying the reluctance versus flux properties of the magnetic return path of a transducer, e.g. the armature of a balanced armature device, allows compensation for nonlinearity arising in another part of the apparatus.

21 Claims, 8 Drawing Sheets

U.S. PATENT DOCUMENTS

| | | | |
|---|---|---|---|
| 6,853,735 | B2 | 2/2005 | Imahori et al. |
| 6,931,140 | B2 | 8/2005 | Van Halteren et al. |
| 7,054,460 | B2 | 5/2006 | Rombach et al. |
| 7,113,604 | B2 | 9/2006 | Thompson |
| 7,166,069 | B2 | 1/2007 | Schneider et al. |
| 7,194,103 | B2 | 3/2007 | Harvey |
| 7,206,425 | B2 | 4/2007 | Vaudrey et al. |
| 7,302,748 | B2 | 12/2007 | Jiles et al. |
| 7,321,664 | B2 | 1/2008 | Van Banning et al. |
| 7,336,797 | B2 | 2/2008 | Thompson et al. |
| 7,362,878 | B2 | 4/2008 | Miller et al. |
| 7,376,237 | B2 | 5/2008 | Westerkull |
| 7,415,125 | B2 | 8/2008 | Warren et al. |
| 7,817,815 | B2 * | 10/2010 | Miller ..... 381/418 |
| 2004/0151340 | A1 | 8/2004 | Miller |
| 2005/0276433 | A1 | 12/2005 | Miller et al. |

FOREIGN PATENT DOCUMENTS

| | | | |
|---|---|---|---|
| JP | 2006041768 | A | 2/2006 |
| JP | 2007074499 | A | 3/2007 |
| WO | WO-2004103019 | A2 | 11/2004 |

OTHER PUBLICATIONS

Stephen C. Thompson, "Internal noise in hearing aid microphones: Its causes and consequences", *The Hearing Journal*, 56(10), Oct. 2003, pp. 46-47.

* cited by examiner

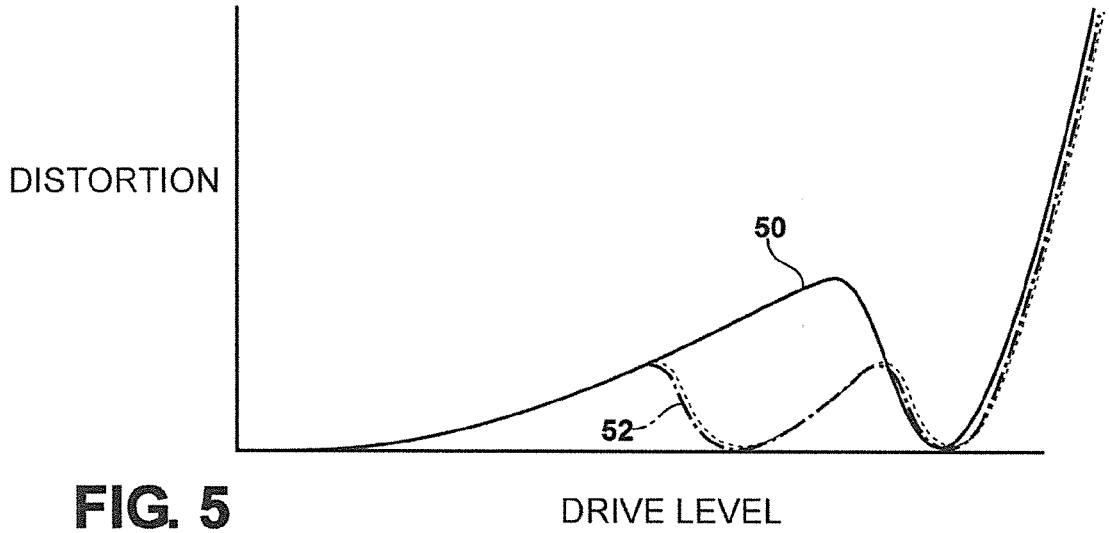
FIG. 5
FIG. 6A
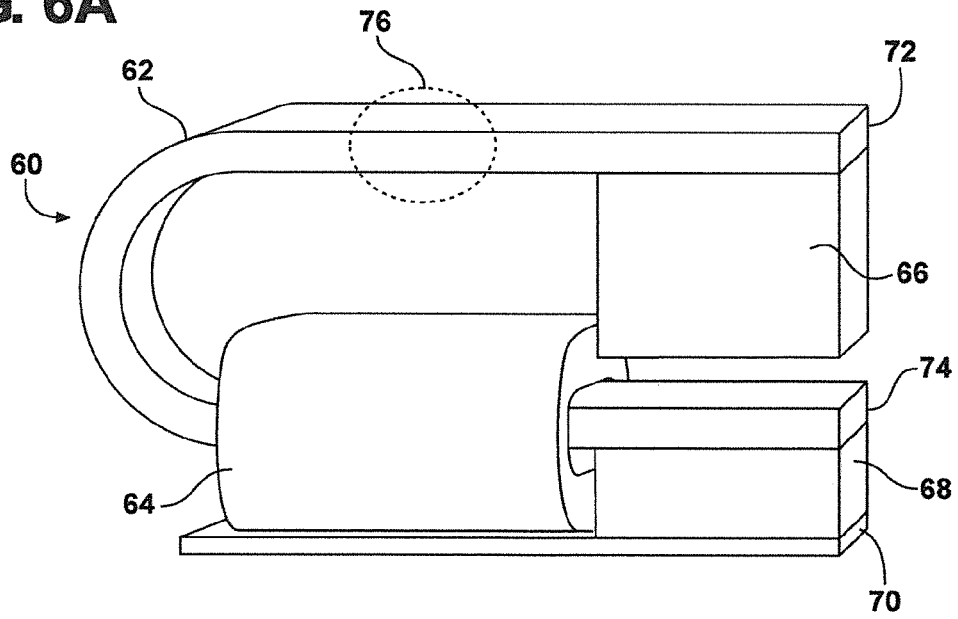

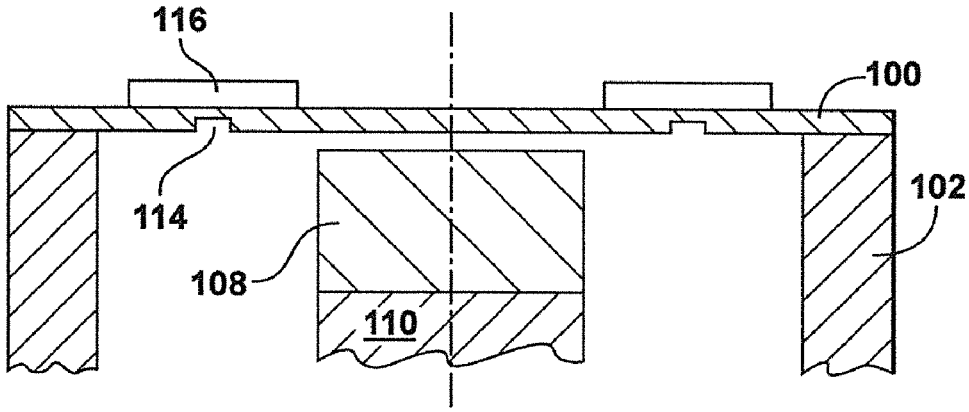
FIG. 7B
FIG. 8
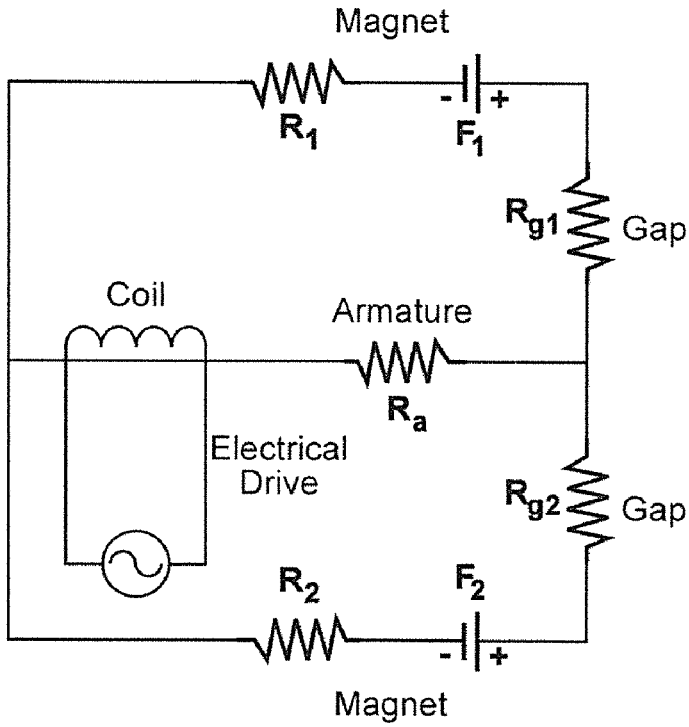

METHODS AND APPARATUS FOR REDUCED DISTORTION BALANCED ARMATURE DEVICES

REFERENCE TO RELATED APPLICATION

This application claims priority to U.S. Provisional Patent Application Ser. No. 61/092,822, filed Aug. 29, 2008, the entire contents of which are incorporated herein by reference.

FIELD OF THE INVENTION

The present invention relates to magnetic apparatus, such as balanced armature apparatus, and methods of improving the performance thereof.

BACKGROUND OF THE INVENTION

Balanced armature devices are used in audio applications such as miniature speakers for hearing aids. Moving coil loudspeakers are more commonly used for larger devices such as home entertainment systems, but moving coil speakers are too inefficient for use in miniature applications. However, conventional balanced armature devices typically suffer from undesirable distortion.

There would be great commercial benefits to the development of reduced distortion balanced armature devices, and further it would be very useful to design structures having a desired magnetic responses for various applications.

SUMMARY OF THE INVENTION

Examples of the present invention include balanced armature apparatus that have improved linearity at moderate to high drive amplitudes. An improved motor can thus be used to make miniature electroacoustic transducers having lower acoustic distortion than prior art designs. In particular, examples include improved miniature speakers, such as hearing aid speakers.

An example balanced armature apparatus, which may be a motor or generator, comprises an armature in which the material(s) of the armature are selected and/or the configuration (such as a layered structure) of the armature is configured so as to reduce distortion in the output of the apparatus. In particular, both harmonic distortion and intermodulation distortion can be reduced to levels appreciably less than would be present using a conventional armature. An armature may comprise one or more high permeability materials, and in some examples a second material provides a flux shunt for a saturated region of the first material above certain drive levels.

Examples of the present invention include hearing aids and audiophile headsets comprising a balanced armature speaker with reduced distortion.

Examples of the present invention further include variable reluctance elements, and variable reluctance devices of any type including such elements. Examples include armature-based variable reluctance devices, such as a variable reluctance device comprising an armature which is configured to provide a variable reluctance. For example, an armature may be configured to have a reluctance versus flux curve that at least in part increases the linearity of a displacement versus flux curve. Examples of the present invention also include cylindrical devices.

A variable reluctance element, such as an armature, may comprise first and second materials, the second material having a higher reluctance than the first material, and the first material including a saturation region, such as a narrowed region, which saturates before the remainder of the first material. The second material then provides a flux shunt around the saturation region for higher fluxes. The saturation region may be a portion of an armature, and may include a narrowed region of reduced cross-sectional area compared to the remainder of the armature.

Examples of the present invention include a balanced armature apparatus comprising an armature in which the material(s) of the armature are selected and/or the layered structure of the armature is constructed such as to provide lower distortion in the output of the device than would be present with a single high permeability material alone.

BRIEF DESCRIPTION OF THE DRAWINGS

FIG. 5 shows the distortion as a function of drive level compared to a prior art device;

FIGS. 6A and 6B illustrate a variable reluctance device;

FIGS. 7A and 7B illustrates example cylindrical devices in cross-section;

FIG. 8 shows an equivalent circuit, allowing numerical optimization of apertures;

DETAILED DESCRIPTION OF THE INVENTION

Figure 1:
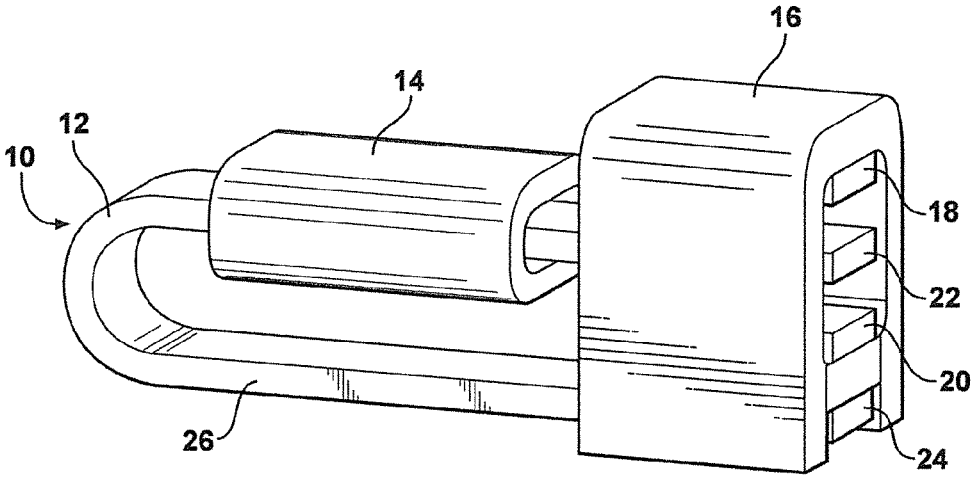
FIG. 1 shows an example balanced armature motor.

Examples of the present invention include balanced armature magnetic motors having reduced distortion compared with conventional devices. Balanced armature devices may be used in various applications, for example miniature speakers for hearing aids, other in-ear speakers, and other miniature audio device applications.

A balanced armature magnetic motor includes an armature having an end portion located in the gap between a pair of magnets. With no drive signal applied, the armature may be positioned at the midpoint of the gap so that the magnetic forces acting on the armature from the magnets are balanced. A drive signal can be applied using a drive coil wound around a portion of the armature. The drive signal increases the attractive force between the armature and one of the magnets (depending on the polarity of the drive signal), displacing the armature towards that magnet. The armature preferably has sufficient rigidity so that it does not deflect far enough towards a magnet so that it ends up sticking to the magnet. Armature saturation may be helpful in preventing large deflections of the armature as further increases in the drive signal strength may not significantly increase deflection, and this helps avoid the armature contacting and sticking to a magnet, which is sometimes referred to as armature collapse and lock-up.

The armature deflection in a balanced armature device is approximately linear for small armature deflections. However, the magnetic force between the armature and a magnet tends to increase as the armature deflects towards the magnet.

This is a source of harmonic distortion in the response of the balanced armature device, which is a problem in applications such as speakers. In a conventional device, the harmonic distortion increases with drive signal strength until the effects of armature saturation occur.

Complete armature saturation occurs at higher drive signals. In a conventional device, the onset of armature saturation may initially counteract the magnetic distortion, and then distortion increases rapidly with signal strength. Complete armature saturation causes extremely high distortion at higher drive levels, and effectively presents an upper limit to practical drive signal strengths. Operation at such higher drive levels is undesirable, and hence the onset of complete armature saturation alone may not present an effective solution to the harmonic distortion problems.

However, embodiments of the present invention use the partial saturation of the armature, for example saturation of portions of the armature such as narrowed regions thereof, to more effectively reduce distortion.

The term higher drive signal strength may refer to drive signals close to or beyond complete saturation of the armature, and medium signals strengths may refer to those less than those that cause the saturation of the entire armature, but over which (conventionally) harmonic generation is a problem. Lower drive signals are those for which the device response is effectively linear even for conventional devices.

In examples of the present invention, the magnetic characteristics of the armature are modified so as to reduce harmonic distortion at medium signal strengths, such signal strengths being significantly less than that required to completely saturate the armature or to induce the onset of complete saturation. The term drive signal may refer to electrical signals applied to the drive coil, or to the resulting magnetic flux that is used to induce deflections of the free end of the armature.

In some examples, saturation of an armature component, such as a narrowed region of the armature, occurs at a first drive signal strength, with saturation of the remainder of the armature occurring at a higher drive signal strength. A flanking piece of lower magnetic permeability (higher reluctance) can be provided proximate the narrowed region. After saturation of the narrowed region, further increases in magnetic flux are carried by the flanking piece (acting as a flux shunt around the saturated region), but the total armature reluctance is increased due to the saturation of the narrowed regions and presence of the flanking piece in the magnetic circuit. The increase in total armature reluctance can be designed to compensate for the effects of harmonic distortion, so that harmonic distortion can be appreciably reduced.

The flanking piece, for example comprising a magnetic material having a higher reluctance than the material used for the remainder of the armature, may be part of the armature, for example as part of a multilayer structure. In some examples, the flanking piece is proximate the armature, for example being adjacent to the armature. The flanking piece provides part of the magnetic circuit for the drive signal, and may comprise a magnetic circuit component in parallel to a narrowed region that saturates at a lower drive field than the flanking material, for example a parallel layer in a multilayer structure, component of a multi-ring structure, adjacent component, surrounding region, core of a tubular structure, or otherwise configured.

A narrowed region may be accompanied by a flanking piece, which provides a parallel magnetic path at a higher reluctance than the armature material. After saturation of the narrowed portion, magnetic flux may be carried by the flanking piece.

An armature may have a generally U-shaped form, with a first generally straight segment (corresponding to one side of the U) having an end within the magnetic gap, a curved segment, and a second generally straight segment attaching the armature. The drive coil may be mounted on the first segment, the first segment being a deflectable segment. The second segment may be a relatively non-deflectable segment that is not deflected relative to the magnet by the drive signal. Other configurations are possible, including E-shaped armatures, linear armatures, and the like. In some cases, configurations according to the present invention may be present in any part of the flux return path for the drive signal, for example within a support structure, base, or other part of the device, or any location where it may effectively act as a flux shunt around a saturated part (such as a narrowed region) of an armature component.

Examples of the present invention include modifications to the structure of a balanced armature magnetic motor that significantly reduce the distortion in the displacement for all drive levels lower than saturation. By proper design of the magnetic parts in the motor, the distortion remains uniformly low as the drive level is increased. Only when saturation of the entire armature occurs does the distortion begin to increase.

The armature reluctance can be modified by reducing the cross-sectional area of the armature along part of its length, and in some examples providing a flanking piece to provide an alternative flux path after saturation of the narrowed region (i.e. as a flux shunt).

Example design modifications include modifications in the construction and/or shape of the part of the armature at some region along its length. A possible location for such a modification is near the end that is fixed to the yoke. However, the same kind of modification may be used at any place along the length of the armature except within the magnetic gap. There may be examples in which such other locations are advantageous. A modification can be positioned at places at one or more positions in any location along the armature.

In a balanced armature speaker, the maximum output level may be limited by magnetic saturation in the armature. Saturation may be intentionally designed into the device for stability. In concept, it should be possible to redesign the device so that saturation occurs at a higher drive level. However, if that were done keeping everything else in the design the same, it would result in substantially higher distortion at moderate drive levels. Thus for a device of a given size, there may be a fixed relationship between maximum output and the saturation at moderate drive.

Examples of the invention provide a way to reduce the distortion at moderate drive level, allowing the motor to be redesigned for higher output without increasing the distortion. In present balanced armature speaker designs, this may allow the output to be increased by 6 to 10 dB while simultaneously reducing the distortion.

Further, the ability to provide an increased output level at acceptable distortion allows hearing aids of a particular acoustic output level to use a smaller speaker. This enables the construction of smaller, less visible hearing aids, and allows speakers that can better fit within the ear canal to provide a better acoustic solution for the user.

FIG. 1 shows an example balanced armature motor, where the free end of the armature vibrates in a magnetic air gap. The apparatus 10 comprises armature 12, a drive coil 14 located so that the wire coils go around a portion of the armature, first and second permanent magnets 18 and 20, and magnetic yoke 16. The armature 12 is generally U-shaped, having an end portion 22 located in the gap between the first and second magnets, and a second end portion adjacent the magnetic yoke. The end portion 22 is free to move under magnetic forces, and with no drive signal applied through the drive coil 14 the end portion is located equidistant from the two permanent magnets 18 and 20.

In some examples of the present invention, the armature has a modified region, such as 26, that gives a reluctance that varies as a function of drive signal strength in such a way as to reduce distortion of the displacement versus drive amplitude behavior. In this context, distortion is a deviation from a linear displacement of the end portion of the armature as a function of drive amplitude.

In this example, an approximately uniform static magnetic field is established in an air gap, originating from the two permanent magnets. The return path for the static field is confined to the magnetic yoke. The U-shaped armature, typically comprising a high permeability material is mounted with one end in the air gap between two magnets, and the other end at a magnetic neutral point of the yoke. The part of the armature outside the yoke passes through a wire drive coil that provides an additional AC magnetic excitation.

If the permanent magnets are equally magnetized, the free end of the armature is exactly centered in the air gap, and if there is no current applied to the coil, then there is no magnetic flux in the armature. There is a magnetic force on the armature in each of the gaps above and below the armature. These forces are equal and opposite, so there is no net force on the armature. However this is an unstable equilibrium. If the armature were to be moved in either direction, the force in the smaller gap increases and that from the wider gap decreases so that the net force pulls the armature farther from center. The spring stiffness of the armature should be strong enough to keep the armature from collapsing into one of the magnets.

If the armature is held fixed in the gaps, and a current begins to flow in the coil, an additional magnetic flux loop is established through the armature, the air gaps, and the yoke. The additional magnetic flux adds to the flux in one gap and subtracts from it in the other gap. This unbalances the magnetic forces on the armature. If the armature is free to move, the unbalanced forces cause a displacement of the end of the armature to a new equilibrium position where the mechanical spring force in the armature is balanced by the magnetic force. If a small AC signal is applied to the coil, the displacement of the armature is approximately proportional to the coil current.

There are two significant sources of nonlinearity in this device. The first is the magnetic nonlinearity. As the armature moves from its static equilibrium position, it is pulled more strongly by the nearer magnet. The net force is approximately linear, but has a small cubic nonlinearity. If the spring force is linear, the unbalanced cubic nonlinearity in the magnetic force creates a distortion in the force vs. displacement of the armature.

A second source of nonlinearity is magnetic saturation in the armature. As the armature moves with higher amplitude, the magnetic flux in the armature grows. The receiver often is specifically designed so that its armature saturates at a vibration amplitude that is less than the distance to the magnets. When the armature saturates, there is no additional magnetic force tending to move the armature toward the magnet.

Combining these two effects, the magnetic force at low drive amplitude is very nearly linear. At higher amplitude, the force grows with displacement faster than linearly due to the cubic nonlinearity in the magnetic force. This continues for moderate drive amplitudes and causes some amount of odd harmonic distortion. As the amplitude continues to increase, saturation starts to occur. The saturation that decreases the force at large displacement partially cancels the cubic magnetic nonlinearity that exists at lower amplitude. The effect is that the distortion starts low, increases at moderate level, decreases dramatically as saturation begins, and then grows again very quickly as saturation continues to increase.

In previous approaches, magnetic devices are built with the magnetic reluctance of the armature being as low as possible, and such that saturation of the armature occurs before the armature makes contact with the magnet. Together, those features give the device a high sensitivity and prevent the tendency of the armature to collapse into a magnet.

Examples of the present invention include modifications of the design in a way that reduces the distortion at moderate drive levels below saturation, in some cases by increasing the overall reluctance of the armature to counteract the unwanted nonlinear response. Previous approaches generally teach away from trying to increase the reluctance of the armature in the drive range of interest.

In some examples, the reluctance and saturation properties of the armature return path are modified in a way that reduces the nonlinearity in the force vs. displacement characteristics of the armature. This can be done by various approaches, including providing a layered structure in a part of the armature magnetic path, and in some cases by narrowing (reducing the cross-sectional area) an armature portion so as to obtain partial saturation of the armature, for example saturation of the armature portion with the remainder of the armature not saturated.

For example, an armature may comprise a first layer and a second layer, the second layer having a lower permeability and higher reluctance than the first layer. At low flux, the first layer may carry essentially all of the flux. At saturation of at least a portion of the first layer, additional flux is carried by the second layer which then acts as a flux shunt.

Figure 2:
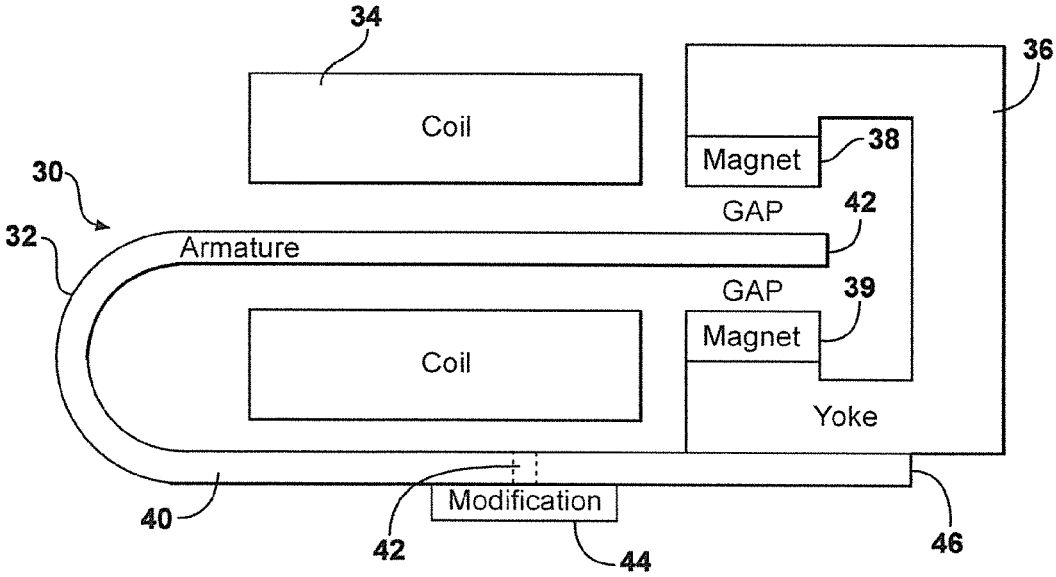
FIG. 2 shows a cross-sectional view of another balanced armature motor.

FIG. 2 shows a cross-sectional view of another balanced armature motor 30, comprising armature 32, drive coil 34, magnetic yoke 36, and permanent magnets 38 and 39. The armature has an end portion 42 in the air gap between the magnets.

Distortion in the displacement vs. drive current arises due to nonlinearity in the magnetic force vs. displacement relationship. If the magnets are equally magnetized and the armature is perfectly centered, the magnetic force is approximately linear for small displacements, but has a cubic nonlinearity that pulls the armature more strongly as it gets nearer to the magnet.

The armature is modified to compensate for this nonlinearity. An arm 40 of the armature has a narrowed region 42, of reduced cross-sectional area, that saturates at a lower magnetic flux than the remainder of the armature. A flanking piece 44 acts as a flux shunt around the narrowed region, carrying most of the magnetic flux after the narrowed region is saturated. The flanking piece has a higher reluctance than the remainder of the armature, so saturation of the narrowed region increases the total reluctance of the armature.

Figure 3:
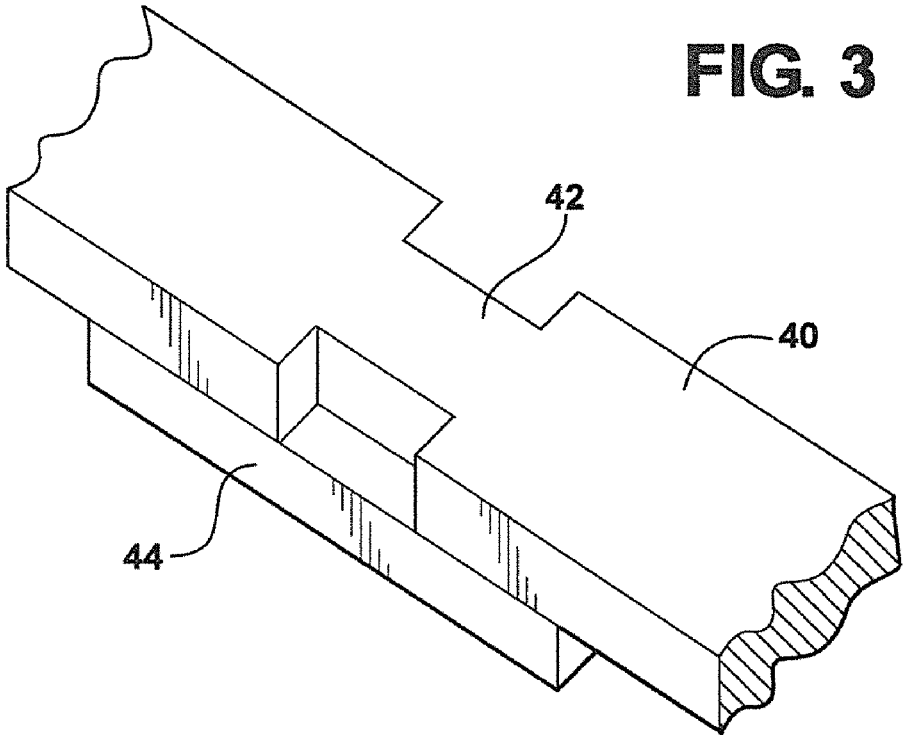
FIG. 3 shows an armature configuration including a narrowed region.

FIG. 3 shows an example implementation. In this implementation, the metal of the armature is narrowed in a short section 42, and a flanking piece 44 comprising a second material with lower permeability (higher reluctance) is attached immediately below and spanning the narrowed region. The Figure shows a small section of the armature that near the flanking piece 44.

As illustrated, the top layer may be the armature of a standard device, modified by having its width reduced in a short region. The bottom layer may be a material with lower relative permeability than the armature, but still much higher than one.

At low drive levels the armature performs similar to a conventional design. Most flux passes through the narrowed region 44 of the first layer, as it has higher permeability (lower reluctance). However, the narrowed region of armature begins to saturate at a lower drive level (and lower flux level) than for the non-narrowed armature. The second layer starts to act as a flux shunt, taking excess flux above that required to saturate the narrowed part of the first layer. As the drive level continues to increase to higher levels, the flux is diverted to the second layer material below the narrowed portion of the first layer.

As the signal strength increases above saturation of the narrowed region, the distortion decreases due to the effect of increased total reluctance of the armature compensating the increased magnetic force between the end of the armature and the magnets for higher deflections.

Figure 4:
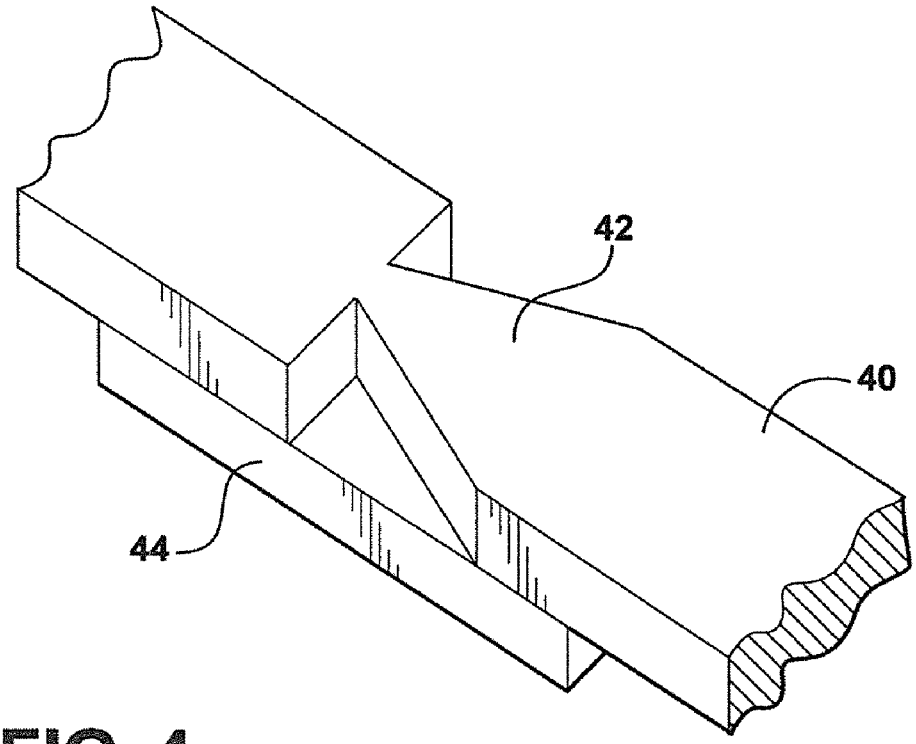
FIG. 4 shows another example implementation.

FIG. 4 shows an alternative implementation, including narrowed region 42 of part of an armature arm 40, with flanking piece 44 providing a flux shunt. The figure shows an armature configuration including a narrowed area. In this example the distortion begins at a low level and increases until the armature begins to saturate at the narrowest region. At this flux level, additional flux is shunted through the flanking piece. Distortion is reduced as the total reluctance increases to maintain a linear relationship between flux and displacement. As the drive current is further increased, the region of saturation grows to include more of the narrowed region of the armature. The contour of the narrowed region can be selected so that the reluctance increases in the proper way to maintain the linear relationship between force and displacement.

FIG. 5 shows the overall distortion vs. drive level curve for a conventional device (curve 50) with an unmodified armature, and improved armature according to an example of the present invention (curve 52), for example as illustrated in FIGS. 2 and 3. At low drive levels, the curves are similar.

The distortion curve (52) of the improved armature falls below curve 50 as the narrowed region saturates and the overall reluctance of the armature increases. As saturation of the narrowed region continues, the flux is shunted through the lower permeability material, and this now becomes a part of the magnetic path in the armature.

As the drive level is increased further, the distortion of the improved device increases again, and may continue to increase until saturation occurs in the full width portion of the first layer (or in the second layer). At this level the distortion quickly decreases again as incipient saturation increases reluctance, and then distortion increase rapidly as saturation becomes complete.

At the drive level where the entire width of the armature saturates, the distortion again increases in a manner similar to a conventional device. The peak value of distortion for drive levels below the ultimate distortion of the armature is considerably lower than in the prior art design.

A characteristic of conventional devices is that the distortion increases at moderate drive levels, then decreases quickly as the armature begins to saturate, then increases again quickly as the saturation continues as the drive level increases further. The distortion as a function of drive level increases rapidly at saturation.

FIG. 6A shows an example variable reluctance apparatus 60 including an armature 62 having free end portion 72 and fixed end portion 74, coil 64, and magnets 66 and 68. This device is analogous to a balanced armature device, and similar armature modifications (e.g. narrowed regions with a magnetically parallel flux shunt) can be applied, for example within modified region 76.

In this example, a coil 64 is disposed around one arm of a generally U-shaped armature, and the other arm supports the permanent magnet 66.

Figure 6B:
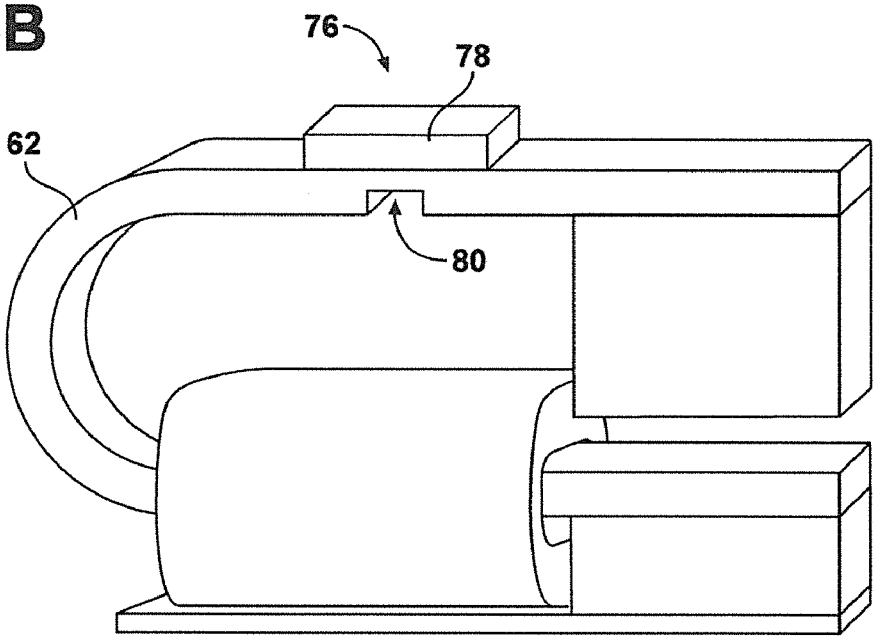

FIG. 6B illustrates implementation of a possible modification, in which the armature 62 has a modified region 76 including a narrowed region 80 and flanking piece 78. As discussed above, the flanking piece 78 acts as a flux shunt when the narrowed region 80 saturates.

Figure 7A:
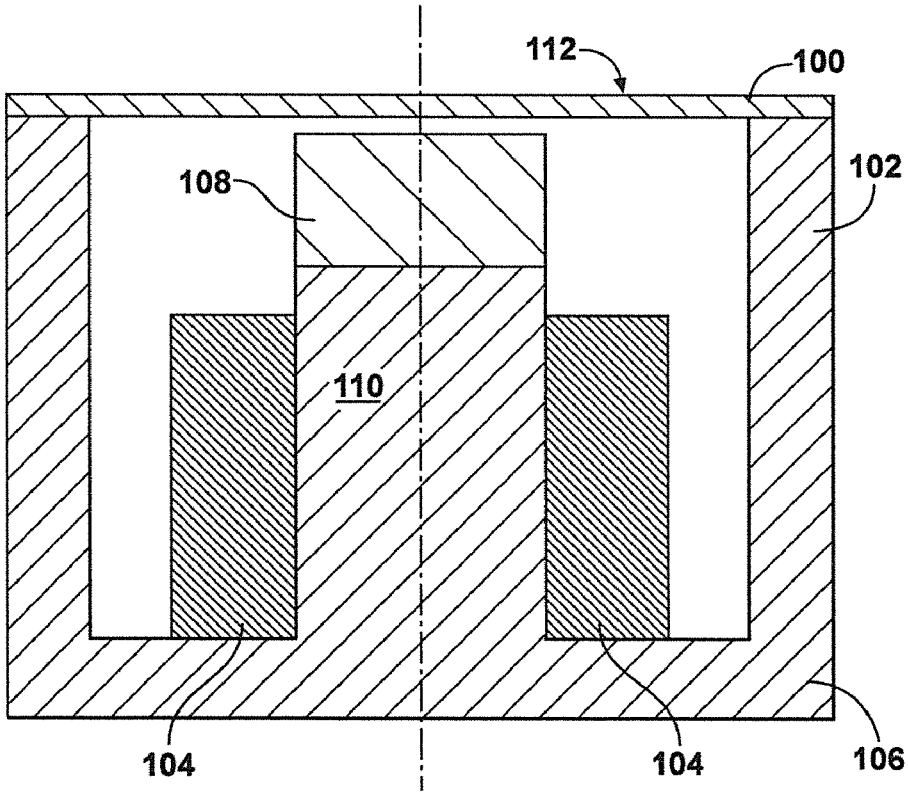

FIG. 7A shows another example of a variable reluctance type device. The device has cylindrical symmetry about the marked axis, and a flexural motion is excited in the diaphragm 100 when an oscillating current is present in the coil 104. In this example, the armature is a generally circular diaphragm, fixed at the edges and with largest movement in the center. The apparatus further comprises cylindrical case 102, base 106, permanent magnet 108, and pole piece 110.

Operation is analogous to other examples. There is a constant force of attraction between the magnet 108 and the diaphragm 112. The stiffness of the diaphragm is preferably sufficient to maintain the separation between the magnet and the diaphragm.

Current in the coil changes the flux in the gap between the magnet and diaphragm, and creates an oscillating force on the diaphragm. This force is nonlinear, being greater when the diaphragm is displaced toward the magnet than when it is displaced away from the magnet.

A magnetic modification to one or more parts of the magnetic return path can be provided, for example analogous to those described in relation to balanced armature devices. For example, a modified region 112 can be provided in the diaphragm. In the cylindrical structure, the configuration may be more complicated than in the armature. For example, the diaphragm (or other element in the magnetic return path) can be a two (or more) layer structure, with the higher permeability layer having cutouts that create small regions where saturation will occur.

FIG. 7B shows details of a possible modification implementation, in which the diaphragm 100 includes a generally circular cut-out 114, creating a circular narrowed region. A generally circular flanking piece 116 is provided adjacent the region of the cut-out, providing a flux shunt.

Examples of the present invention include any armature-based variable reluctance device, such as a variable reluctance device comprising an armature which may be modified as discussed elsewhere. Examples of the present invention further include cylindrical devices, which in some cases may be less costly to manufacture.

FIG. 8 shows the magnetic circuit of a balanced armature transducer (for example, the apparatus shown in FIG. 1) represented by an analog circuit. Analysis of this circuit, described in more detail below, shows that the reluctance versus drive current behavior of the armature can be numerically designed to obtain a linear relationship between drive current and armature displacement.

Figure 9A:
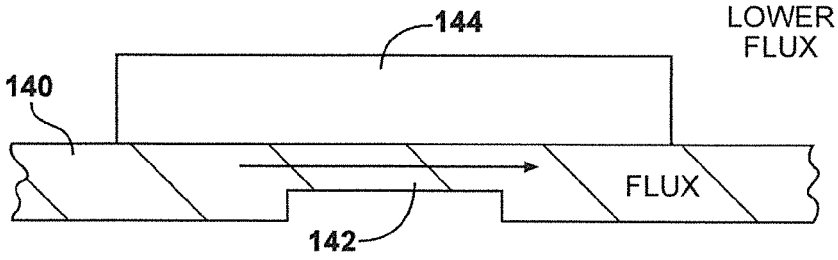
FIGS. 9A and 9B illustrate the faction of a flux shunt around a saturation region.

FIG. 9A shows a cross-section of a portion of an armature 140 including a narrowed portion 142 and a flanking piece 144, similar to that shown in FIGS. 3 and 4. In this example, the thickness of the narrowed portion is reduced relative to the surrounding armature. In other examples, the width and/or thickness may be adjusted to reduce the cross-sectional area.

Figure 9B:
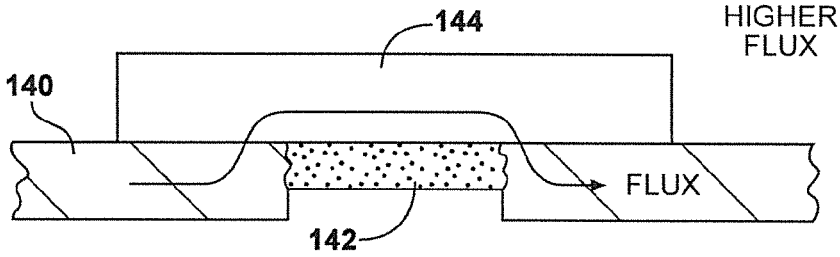

FIG. 9B illustrates that for drive currents above those necessary to saturate the narrowed region, the flanking piece acts as a flux shunt around the saturated region. However, if the flanking piece acting as a flux shunt has a higher reluctance than the low-field reluctance of the shunted portion of the armature, the total reluctance of the armature is increased.

Figure 10:
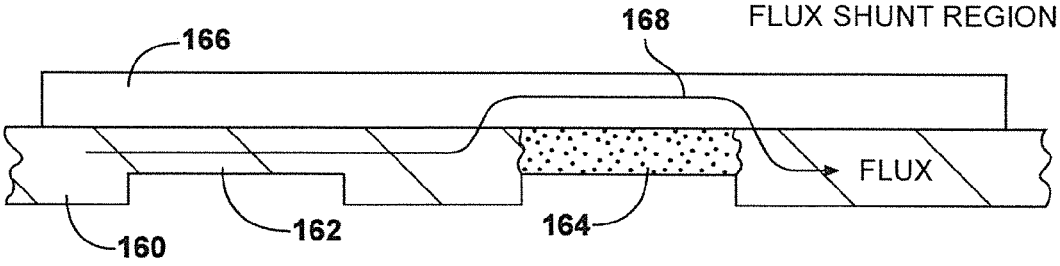
FIG. 10 illustrates the use of a plurality of saturation regions.

FIG. 10 illustrates an armature having an armature portion 160 including first and second narrowed regions 162 and 164, respectively. The figure shows the flux direction for a driving field higher than that necessary to saturate the second narrowed region, but below that necessary to saturate the first narrowed region. In this case, the flanking piece acts as a flux shunt for the second narrowed region. At higher fields where both narrowed regions saturate, the flanking piece acts as a flux shunt for both narrowed regions.

Figure 11A:
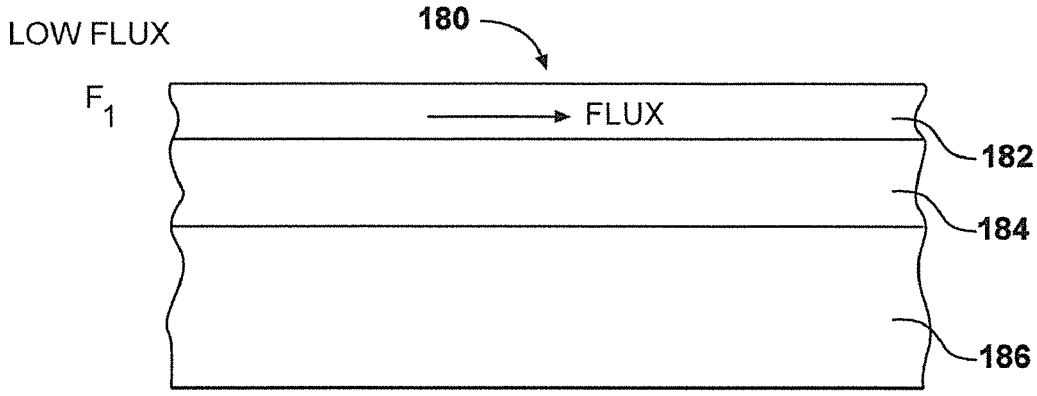
FIGS. 11A-11C illustrate a multilayer armature.
Figure 11B:
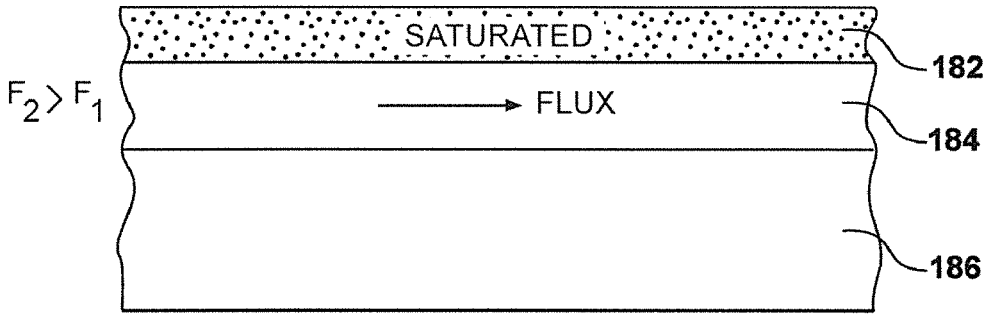
Figure 11C:
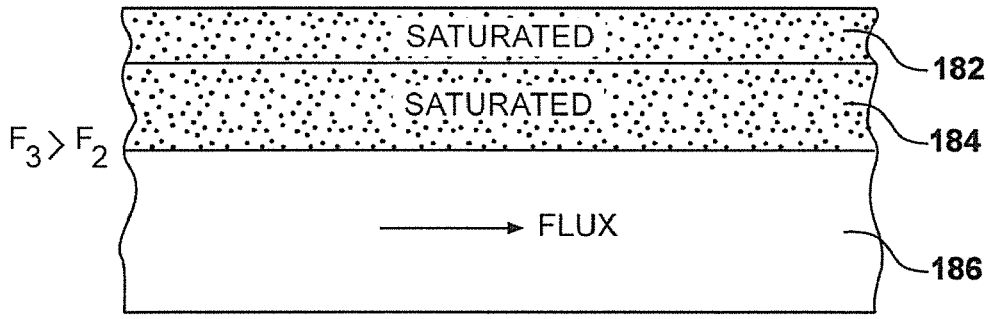

FIGS. 11A-11C illustrates a multilayer structure 180 that can be used in some or all of an armature, and which does not require a narrowed region. FIG. 11A shows a first layer 182, second layer 184, and third layer 186. The reluctance per unit length of each layer increases in the order first layer, second layer, then third layer (highest). The first layer may be relatively thin, compared with conventional designs.

FIG. 11A shows that at a low flux F1, no layer is saturated and most flux is conveyed by the first layer, as this has the lowest reluctance. FIG. 11B shows that at a higher flux F2 (F2>F1), the first layer saturates and most flux now is conveyed by the second layer. FIG. 11C shows that at a higher flux F3 (F3>F2), the first and second layers are saturated and most flux is now conveyed through the third layer.

Hence, an example armature includes a multilayer portion formed from at least two layers, a first layer saturating at a lower flux level than the second layer, the second layer having a higher reluctance than the first layer. The entire first layer may become the saturating region, and flux gets shunted to the second layer. An armature may comprise a plurality of such layers of different permeability and thickness, without needing to add a further thinned or otherwise constricted region, allowing the armature reluctance versus flux behavior to be tailored to a desired relationship.

Figure 12:
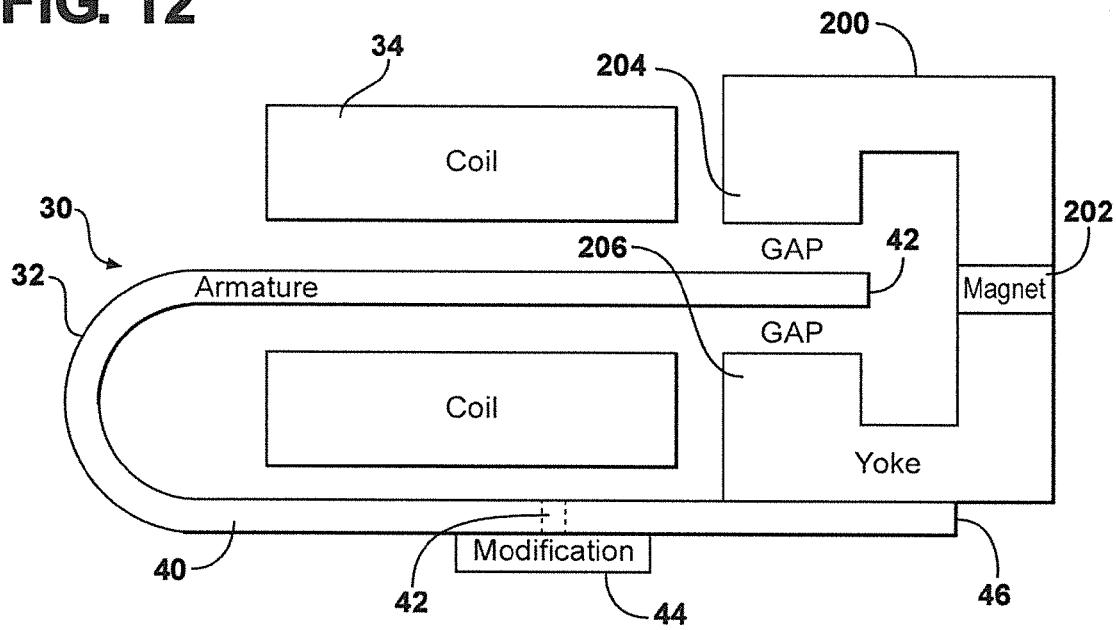
FIG. 12 illustrates a single magnet balanced armature apparatus.

FIG. 12 shows a modified version of FIG. 2, in which the pair of permanent magnets supported by a magnetic yoke is replaced by a single permanent magnet 202 and a slightly modified magnetic yoke 200 with end portions 204 and 206. There is a gap between the end portions of the yoke, the end portion of the armature 42 extending into this gap to define two gaps above and below the armature (as illustrated). In this example, the yoke is used to convey magnetic flux from the permanent magnet to the gaps. In other examples, a single magnet can be located at any location within the magnetic yoke, the yoke being used to convey the flux to the gap.

Armature Reluctance

The reluctance of the armature may be expressed as $R=1/\mu_0\mu A$, where l represents length, $\mu_0$ is the permeability of free space, $\mu$ is the relative magnetic permeability of the material, and A is the cross-sectional area.

In a conventional device, the cross-sectional area A is generally constant along the length of the armature, and the reluctance per unit length (R/1) is substantially constant along the length of the armature. The saturation field for the armature is generally constant along the entire length of the armature. The armature may be slightly broader in the region under the yoke, possibly to increase the attachment area between the armature and the yoke. However, in a conventional device, there is no significant narrowing of the armature, or any other feature that would tend to increase the reluctance.

In some examples of the present invention, the reluctance per unit length R' varies along the length of the armature. (The symbol R denotes reluctance, and R' denotes reluctance per unit length). An armature may include a first portion having a first value of R', and second and third portions having second and third values of R'. The first value of R' may be less than the second or third versions.

In some examples, an armature includes a portion of reduced cross-sectional area A, for example a tapered or narrowed region. Narrowing may be achieved by a reduced width and/or a reduced thickness. The magnetic saturation flux for the narrowed region is lower than for the remainder of the armature, and hence the narrowed region saturates at a lower drive signal strength than the remainder of the armature.

A flanking piece can be located proximate the narrowed region to allow a parallel path for magnetic flux, and the reluctance of the flanking piece may be greater than the remainder of the armature. Hence, the reluctance of the armature is increased for drive fields between that required to saturate the narrowed region and that required to saturate the remainder of the armature. However, the increase in reluctance can be relatively small (for example between 0.1 and 10%) relative to small drive field strengths, and can be well controlled by design of the narrowed region and the flanking piece.

Hence, the saturation properties of the armature can be modified so as to reduce harmonic distortion at medium signal strengths significantly less than fields required to totally saturate the armature. In some examples, saturation of an armature component occurs at a medium signal strength, with saturation of the complete armature occurring at a higher signal strength.

Armature Design and Materials

Examples of the present invention include armatures having one or more regions having a cross-sectional area that less than adjacent armature regions. These regions may be achieved by stamping an armature of approximately constant thickness but having a narrower region, so that the regions may be referred to as narrower regions. Other approaches may be used, including regions of reduced thickness and/or width.

An armature may comprise bilayer portions, for example as shown in FIGS. 3 and 4, the remaining part of the armature being a single layer. A flanking piece (second layer) may be considered part of the armature, or a separate component, but in either case acts as part of the flux return path for the drive signal.

In some examples, a portion of the armature may comprise a bilayer, and there may be one or more narrowed regions of the first layer within this armature portion.

In some examples, some or all of the armature may comprise a multilayer with two or more layers. For example, as the field increases, the first layer (or a narrowed portion thereof) may saturate first, the remaining layers acting as a flux shunt for the saturated layer or part thereof. At higher fields, a second, third etc. layer may saturate at increasing field strengths. In this way, an element having a precise desired variation in reluctance may be fabricated.

An improved armature may include a strip of magnetic material including a region of narrowed thickness, for example produced by mechanical process such as coining. A flanking piece may be provided by a second magnetic material, and the flanking path may be part of the armature or proximate to it.

In some examples, an armature may be formed by stamping out a metal strip. A region of narrowed width may be readily formed during the stamping process. The metal strip may be bent into a generally U shaped configuration.

An armature may comprise a conventional magnetic material, such as a permalloy (or other a iron-nickel magnetic alloy), iron-silicon materials such as silicon steel, or other material.

The armature may comprise a first material having a first permeability and a second material having a second permeability (for example, 0.2-0.8 of the first permeability). The first material has a region of reduced cross-sectional area (narrowed region) so that the region saturates at a first threshold before the remainder of the first material saturates at a second threshold. At fields between the first and second threshold, a flanking piece acts as a flux shunt. However, the higher reluctance of the flux shunt increases the overall reluctance of the armature.

For example the relative permeability of the first material may be around 5,000-100,000 (for example, about 80,000, and may be higher for some materials such as supermalloys) at low fields, falling to near unity within a narrowed region at a first threshold where the first material saturates. For example, permalloy may have a permeability of ~80,000, and silicon steel may be higher.

Materials such as permalloy, other nickel iron based magnetic alloys, silicon steel, or other materials may be used for the first material. The second material may have a permeability appreciably less than the first material, for example between 0.05 and 0.9 of the permeability of the first material, more particularly between 0.1 and 0.8 of the permeability of the first material, for example around half. These ranges are exemplary, and other values may be used. For example, the second material may comprise a lower permeability (relative to the first material) magnetic alloy, ferrite, iron and/or nickel or alloy thereof, and the like.

Below the first threshold, most of the magnetic flux is carried by the first material. Between the first and second thresholds, most flux is carried by the flux shunt around the narrowed region, and the reluctance is increased in a manner that can be tailored to a specific application.

Analysis

One of ordinary skill in the art will recognize that the magnetic circuit of a balanced armature transducer (for example, as shown in FIG. 1) can be represented by the analog circuit of FIG. 8. This model follows the convention that electrical current is analogous to magnetic flux, and electrical voltage is analogous to magnetomotive force. The resistive components in the circuit are magnetic reluctances whose values are calculated as:

$$R = \frac{\ell}{\mu_0 \mu_r A} \tag{1}$$

where l and A are the length and area of the piece, $\mu_r$ is its relative permeability, and $\mu_0$ is the permeability of free space. The DC voltage sources $F_1$ and $F_2$ are the magnetomotive forces produced by the two magnets. The reluctances $R_1$ and $R_2$ include the reluctance of one of the magnets and any remaining reluctance in the magnetic return path. $R_a$ is the reluctance of the armature. The coil adds an additional magnetomotive force to the armature equal to NI where N is the number of turns on the coil, and I is the coil current. The two air gaps are represented by $R_{g1}$ and $R_{g2}$. This circuit is shown with the armature centered in the two gaps. If the armature is displaced from its equilibrium position by an amount x, then the two reluctances change according to $$R_{g1} \Rightarrow R_{g1} + \frac{x}{\mu_0 A} \text{ and } R_{g2} \Rightarrow R_{g2} - \frac{x}{\mu_0 A} \tag{2}$$

If $\phi_1$ is the magnetic flux flowing clockwise in the upper loop and $\phi_2$ is the flux flowing clockwise in the lower loop, then the equations that describe this circuit are:

$$(R_1 + R_{g1})\phi_1 + R_a(\phi_1 - \phi_2) - (F_1 - NI) - \frac{x}{\mu_0 A_g}\phi_1 = 0 \tag{3}$$

$$(R_2 + R_{g2})\phi_2 - R_a(\phi_1 - \phi_2) - (F_2 + NI) + \frac{x}{\mu_0 A_g}\phi_2 = 0 \tag{4}$$

For any particular value of the armature displacement x, the coil current, in combination with the magnets, establishes the values of the loop fluxes $\phi_1$ and $\phi_2$. Then there is a mechanical force on the armature given by $$F = \frac{\phi_1^2}{2\mu_0 A} - \frac{\phi_2^2}{2\mu_0 A}. \tag{5}$$

We assume that the armature has sufficient mechanical stiffness to resist this force and avoid the collapse of the armature into either magnet. If the spring stiffness constant of the armature is k, and the mechanical system is in equilibrium, the spring force is equal to the magnetic force, or $$-kx = \frac{\phi_1^2}{2\mu_0 A} - \frac{\phi_2^2}{2\mu_0 A}. \tag{6}$$

Equations 3 and 4 represent three equations in the three unknowns $\phi_1$, $\phi_2$ and x, thus it should be possible to solve these equations for x as a function of NI. It can be shown that x and NI are related as the solution to the following polynomial equation:

$$\begin{aligned} 0 = {} & kX^5 - kX^3(2R^2 + 4RR_a) + 4FNIX^2 + \\ & X[-4NI^2R - 4F^2R - 8F^2R_a + k(R^4 + 4R^3R_a + 4R^2R_a^2) - 8F^2R_a] - \\ & 4R^2FNI - 8RR_aFNI \end{aligned} \tag{7}$$

where $X = x/\mu_0 A$.

Equation 7 shows the essential nonlinearity of the balanced armature transducer.

Using the methods described herein, however, it is possible to design the system to remove the nonlinearities.

This is done by allowing the armature reluctance $R_a$ to be a nonlinear function of the flux it carries. Let $R_a$ be replaced by $R_a + R_{ax}$ where $R_a$ is constant, the value of $R_{ax}$ is zero when the armature flux is zero, and increases as the flux increases in such a way as to maintain a linear relationship between drive current and displacement. With this modification, Equation 7 becomes $$\begin{aligned} 0 = {} & kX^5 - kX^3(2R^2 + 4RR_a + 4RR_{ax}) + 4FNIX^2 + \\ & X\begin{bmatrix} -4NI^2R - 4F^2R - 8F^2R_a - 8F^2R_{ax} + \\ k(R^4 + 4R^3R_a + 4R^3R_{ax} + 4R^2R_a^2 + 8R^2R_aR_{ax} + 4R^2R_{ax}^2) \end{bmatrix} - \\ & 4R^2FNI - 8RR_aFNI - 8RR_{ax}FNI \end{aligned} \tag{8}$$

One strategy is to partition the terms of this equation into two parts. One part contains all terms that are nonlinear in X and NI, and all terms that contain the factor $R_{ax}$. The other part, then, is left only with terms that are linear. With this partitioning, the equation becomes $$0 = \left\{ \begin{array}{l} kX^5 - kX^3(2R^2 + 4RR_a + 4RR_{ax}) + 4FNIX^2 + \\ X[-4NI^2R - 8F^2R_{ax} + k(4R^3R_{ax} + 8R^2R_aR_{ax} + 4R^2R_{ax}^2)] - \\ 8RR_{ax}FNI \end{array} \right\} + \left\{ \begin{array}{c} X[-4F^2R - 8F^2R_a + k(R^4 + 4R^3R_a + 4R^2R_a^2)] - \\ 4R^2FNI - 8RR_aFNI \end{array} \right\} \quad (9)$$

Example methods and apparatus of the present invention allow design of the armature reluctance $R_{ax}$ so that the first term in braces is equal to zero for all drive levels.

This gives $$0 = kX^5 - kX^3(2R^2 + 4RR_a + 4RR_{ax}) + 4FNIX^2 + X[-4NI^2R - 8F^2R_{ax} + k(4R^3R_{ax} + 8R^2R_aR_{ax} + 4R^2R_{ax}^2)] - 8RR_{ax}FNI \quad (10)$$

Then the second term in braces is also zero, so that $$X = \frac{4R^2F + 8RR_aF}{-4F^2R - 8F^2R_a + k(R^4 + 4R^3R_a + 4R^2R_a^2)}NI \quad (11)$$

which specifies a linear relationship between drive current and armature displacement.

An example approach to design the armature reluctance, for any particular balanced armature design, is to find a simultaneous solution of the above equations.

The nonlinearities in these equations make this a very difficult task to do by hand. However the solution can be found either using numerical methods, or using a computer symbolic algebra program. Commercial programs such as Mathematica (Wolfram Research, Champaign, Ill.) or Maple (Maplesoft, Waterloo, ON) may be used. A solution can also be obtained using open source computer code Maxima, which can be obtained from the SourceForge at http://maxima.sourceforge.net/.

This analysis can be used to design materials having the reluctance properties necessary to reduced distortions in an armature response. This analysis can also be used to tailor a tapered profile of narrowed regions, for example as discussed in relation to FIG. 4, and to design other armature configurations such as multiple narrowed regions.

Conventionally, the relationship between drive current levels in the coil and the mechanical force driving the armature is nonlinear. For small displacements it is approximately linear, but the nonlinearity grows as the displacement increases.

The armature reluctance can be configured to vary with armature flux in a way that eliminates the nonlinearity in the current (drive signal level) vs. displacement relationship. The numerical solution becomes a design goal for the armature. A layered armature structure, or single material armature, can be configured to have the desired reluctance vs. flux behavior, allowing the transducer displacement relationship to be linear.

Armature Materials Having Modified Saturation Curve

In some examples, a material whose B/H saturation curve provides the proper variation of reluctance versus flux to may be used to provide a linearized distortion vs. drive level curve below the saturation flux of the armature. Example materials include ferrite material (ferrites). For example, the reluctance versus magnetic field strength of a ferrite or other material may be designed so as to reduce the distortion level for drive levels below the armature saturation flux. The reluctance may decrease slightly (for example 0.1-10%) over medium drive levels below the saturation flux.

Hence, in some examples of the present invention, no narrowed region or flux shunt is required, though such structures may be used if desired to obtain a desired saturation curve.

The variation in reluctance versus field strength is conventionally considered a problem in ferrite materials. A ferrite material may be included within some point of the return flux path, for example in a non-flexing portion of the armature configuration. The armature can be designed using the analysis described above.

Ferrites that may be used include non-conductive ferromagnetic ceramic compounds, for example including one or more metal oxides, such as iron oxide, manganese oxide, nickel oxide, zinc oxide, and/or other oxides. Ferrites may be inorganic ceramics, or in other examples plastic or plastic-inorganic composite materials. For example, an armature portion, or other part of the flux path of the drive signal, may comprise a soft ceramic ferrite. The composition of the ferrite, grain size distribution, and physical structure may be adapted to obtain a desired magnetic performance.

Applications

Examples of the present invention include methods and apparatus for reducing the distortion in the output of a balanced armature device, including miniature devices used in hearing aids and headphones. The reduced distortion significantly improves audio quality.

A balanced armature magnetic motor can be used as the driver in the miniature loudspeakers use in hearing aids, in-ear monitors, and some high-end earphones. For very small speakers such as these, the balanced armature drive structure provides a greater acoustic output than other transducer structures of equivalent size. A balanced armature speaker can provide good acoustic performance, but even the best conventional designs have a higher level of acoustic distortion at moderate output power than is desired for high quality listening systems.

Examples of the present invention include improved electromagnetic transducers such as speakers and microphones, for example for use in hearing aids, other ear-implanted speakers, bone-conduction audio devices, cell-phones, other telephones, earpieces, radios, portable music players, other entertainment devices, and the like.

Example devices, such as hearing aids, may comprise a housing, for example configured to be located within, behind, or close to a person's ear. A drive rod and/or linkage mechanism may be used to couple armature vibrations to a vibrating diaphragm, for example as described in U.S. Pat. No. 7,336,797 to Thompson et al., incorporated herein by reference.

Applications also include any device where a variable reluctance element is useful.

Alternative Implementations

Other examples of the present invention include armatures comprising multiple layers having different parameters so as to reduce distortion. For example, layers may have different thickness, permeability, and/or saturation level to achieve improved performance. For example, armatures may include multiple underlying layers.

Examples of the present invention include balanced armature apparatus (such as balanced armature motors and balanced armature generators) in which the material(s) of the armature are selected and the layered structure of the armature is constructed such as to provide lower distortion in the output of the device than would be present with a single high permeability material alone.

Other Configurations

Examples of the present invention include multi-layer structures. Such multiple layers can provide several points of partial saturation at each of which the distortion is reduced. This can provide reduced distortion vs. drive level, for example having several smaller peaks and dips with a lower peak level below ultimate distortion (saturation of the armature).

Examples of the present invention also include the use of several two-layer (or other multiple layer) sections spaced at different positions along the length of the armature. Layers may be thinned normal to the layers, narrowed parallel to the plane of the layers, or some combination of constrictions. Layers may be planar. In some examples, layers may be cylindrical, for example a layer of a second material around a narrowed cylindrical core of a first material.

An example device may have a plurality of sections of narrowed dimension (reduced cross-sectional dimension or area through which flux can propagate), which may be similar or different. For example, an example device may have two such sections of different narrowed dimension. The narrower section begins to saturate at a first drive level to reduce the distortion. However, on further increase in drive level, the distortion increases again. At a higher drive level, the second narrowed region begins to saturate and again reduce the distortion. Distortion continues to increase as the drive level is further increased until saturation of the full width armature starts to occur. Here the distortion falls for a third time before increasing as the full width section goes into hard saturation.

Examples of the present invention also include magnetic structures providing a desired reluctance versus flux relationship, including multilayer structures, composites, and the like. For example, a composite may include strips, wires, or particles of a first material within a second material, the first material having a lower reluctance and saturating at a lower field.

Some examples of the present invention include a layer of a first material and a layer of a second material having a higher reluctance than the first layer. At least part of the first layer (for example, a narrowed region, or in some cases the entire layer) saturates at a medium flux value so as to counteract nonlinearity of device response.

In some examples, structures according to examples of the present invention may be configured so as to decrease reluctance at medium drive field strengths, for example for other applications, and these may be used in various applications, not limited to balanced armature devices.

Conventional balanced armature transducers comprise an armature made from a single high permeability material. Some example armatures of the present invention comprise first and second magnetic materials of different reluctance values, in which the flux carrying ratio of different materials is a function of drive signal strength, so as to obtain a desired reluctance curve. In some examples, the electronic gain curve of a driving amplifier can be modified to remove any residual distortion components, for example by intentionally introducing nonlinearities that compensate any residual distortion.

Improved armatures according to embodiments of the present invention may be designed using models such as nonlinear magnetic models, ODE and/or FEA models. Improved balanced armature and variable reluctance devices according to embodiments of the present invention may be used in products that do not presently use them, such as devices presently using moving coil devices.

Examples of the present invention further include variable reluctance generators and variable reluctance motors including structures such as those described herein. For example, a switched reluctance element such as an armature may include first and second magnetic materials, at least part of the first material being saturated by a drive signal of a certain field strength so as to modify the reluctance of the structure (for example, a higher reluctance above the certain field strength where the second material has a higher non-saturated reluctance than the first material).

For example, the second material may act as a flux shunt around a saturated portion of the first material, and the total reluctance increases as the second material has a higher reluctance. However, the increase in reluctance can be controlled, and may be relatively small, for example in the range 1%-100%.

In some examples, a saturation region may be provided by a portion of third material inserted into a structure formed from a first material, magnetically in series with the first material. The saturation region saturates at a lower field than the remainder of the first material, for example due to physical constriction and/or lower saturation field of the third material. A flux shunt, e.g. of a second material, can be provided around the saturation region.

In some examples, a variable reluctance element comprises a multilayer structure of a first material and a second material, the second material having a higher reluctance than the first material, the first material having a lower saturation field than the second material. Saturation regions, such as narrowed regions, may be provided in the first material, but in some examples need not be present. At low flux, the flux is carried largely by the first material. Above a first threshold flux, the second material acts as a flux shunt and carries flux around the first material, or saturated portions thereof. Similarly, a third layer having a lower reluctance than the second layer, and higher saturation than the second layer, may also be present. The third layer may act as a flux shunt to the second layer or saturated portions thereof above a second threshold flux. Other layers may be added in an analogous fashion, so that reluctance versus field can be precisely tailored using reluctance variations at one or more threshold fields before saturation of the entire element. In some examples, a variable reluctance element may comprise a gradient permeability material, having e.g. a composition and hence permeability and/or saturation field that varies in a direction normal to the flux propagation direction, so that a portion of the material may act as a flux shunt to a saturated portion thereof (for example, a narrowed region or lower saturation field portion).

Examples of the present invention include balanced armature apparatus (such as balanced armature motors and balanced armature generators) in which the armature is configured such as to provide lower distortion in the output of the device than would be present using a conventional armature. The material(s) of an improved armature can be selected and/or a layered structure of the armature can be constructed so as to reduce output distortion.

A flux shunt may be part of an armature or other desired variable reluctance element, adjacent, or proximate.

Examples of the present invention include a modification of the reluctance of the magnetic return path of a transducer to compensate for a nonlinearity in another part of the transducer. Specific implementations described herein are exemplary and not limiting. An example approach performs the modification by narrowing the width of the armature in the return path. In other examples, it is possible to reduce the thickness, in effect to use a layered structure for at least part of the return path.

An example magnetic apparatus, such as a balanced armature apparatus, comprises first and second magnets, and an armature having an end portion located within the gap between the first and second magnets. A drive coil is magnetically coupled to the armature, so that a drive signal applied to the drive coil induces magnetic flux within the armature and a corresponding deflection of the end of the armature. The armature can be configured so as to reduce harmonic distortion in deflections of the armature. For example, the armature may include at least one portion configured to saturate at a drive signal level less than required to saturate the remainder of the armature. The armature may include a narrowed region of first magnetic material saturating at a drive signal level less than a remainder of the first magnetic material.

The armature may comprise a first material and a second material, at least one portion of the first magnetic material saturating at a drive signal level less than the second magnetic material, the second magnetic material providing a flux shunt around the at least one portion of the first material when the at least one portion of the first material is saturated. At least part of the first magnetic material may saturate at a drive signal level less than the second magnetic material.

In some examples, the armature comprises a material with a B/H saturation curve providing a variation of reluctance versus flux so as to provide a linearized distortion versus drive level curve below its saturation flux. The material may be a ferrite.

An armature may include a multi-layer structure having one or more portions of partial saturation, the portions of partial saturation being saturated by a drive signal substantially less than that required to saturate the entire armature.

An armature may include a plurality of multilayer structures spaced at different positions along the length of the armature.

A multi-layer armature structure may comprise at least a first layer and a second layer, the first layer having one or more narrowed regions of reduced cross-sectional area, the narrowed regions each having a lower saturation field than the remainder of the first layer.

An armature may be configured so as to have a distortion vs. drive level curve that has several peaks and dips, the peak levels below ultimate distortion being reduced.

An example magnetic apparatus comprises a variable reluctance element comprising a first magnetic material, a second magnetic material, and a drive coil, the drive signal being applied to the drive coil inducing magnetic flux within the device, and at least part of the first magnetic material saturating at a drive signal level less than the second magnetic material, the reluctance of the variable reluctance element being modified by saturation of at least part of the first magnetic material. The apparatus may be a balanced armature device, with the variable reluctance element being an armature. The first material may comprise a saturation portion that saturates at a drive signal less than proximate portions of the first material, the second material providing a flux shunt around the saturation portion when the saturation portion is saturated. Example apparatus include a variable reluctance motor, or a variable reluctance generator.

An example apparatus comprises a drive coil energizable by a drive signal, a permanent magnet, and at least one magnetic return path element for flux induced by the drive signal, the magnetic return path element being configured to provide a variable reluctance, so as to reduce nonlinearities in displacement versus drive signal for a displaceable element.

Other examples include the use of similar structures (e.g. armature designs) as described here include use in the magnetic path of a variable reluctance motor/generator.

Patents or publications mentioned in this specification are herein incorporated by reference to the same extent as if each individual publication was specifically and individually indicated to be incorporated by reference.

One of ordinary skill in the art would notice a large number of similar structures that accomplish the same objective.

The invention is not restricted to the illustrative examples described above. Examples described are exemplary, and are not intended to limit the scope of the invention. Changes therein, other combinations of elements, and other uses will occur to those skilled in the art. The scope of the invention is defined by the scope of the claims.

I claim:

1. A balanced armature apparatus, comprising:

a first permanent magnet;

a second permanent magnet;

an armature, having an end portion located between the first permanent magnet and the second permanent magnet; and a coil, the coil being magnetically coupled to the armature, the coil being energizable by a drive signal so as to induce a flux level within the armature and a deflection of the end portion of the armature, a displacement relationship relating the displacement to a drive signal level, the armature being configured to have a reluctance that increases with the drive signal level so as to improve linearity of the displacement relationship, for flux levels less than those required to initiate saturation of the entire armature, the armature including a partial saturation portion configured to saturate at a drive signal level less than required to saturate an adjacent portion of the armature, the apparatus further comprising a flanking piece providing a flux shunt around the partial saturation portion when the partial saturation portion is saturated, the flux shunt having a higher reluctance than the partial saturation portion of the first material.

2. The apparatus of claim 1, the partial saturation portion comprising a narrowed region having a lower cross-sectional area than other portions of the armature.

3. The apparatus of claim 2, the narrowed region including a tapered portion in which cross-sectional area varies with position along the armature.

4. The apparatus of claim 1, the armature comprising a first magnetic material, and a second magnetic material, a portion of the first magnetic material saturating at a drive signal level less than required to saturate the second magnetic material, the second magnetic material providing a flux shunt around the portion of the first material when the portion of the first material is saturated.

5. The apparatus of claim 1, the armature having a saturation flux for complete saturation of the armature, the armature comprising a magnetic material having a variation of reluctance versus flux through the armature configured to provide a generally linear displacement relationship below the saturation flux.

6. The apparatus of claim 5, the armature comprising a ferrite material having a reluctance versus armature flux curve configured to compensate for harmonic distortion in the displacement relationship.

7. The apparatus of claim 1, the apparatus being a balanced armature motor.

8. The apparatus of claim 1, the apparatus being further operable as a balanced armature generator.

9. The apparatus of claim 1, the apparatus being a balanced armature speaker.

10. The apparatus of claim 9, the apparatus being a hearing aid speaker.

11. An apparatus, the apparatus being an armature for a balanced armature device, the armature having an armature saturation flux at which the armature is completely saturated, the armature including a multi-layer portion including:

a first layer including a partial saturation region, the partial saturation region being saturated by an armature flux level less than the armature saturation flux; and a second layer operational as a flux shunt around the partial saturation region when the partial saturation region is saturated, the partial saturation region of the first layer saturating at lower flux levels than required to saturate proximate portions of the first layer, the flux shunt having a higher reluctance than the partial saturation region of the first layer.

12. The apparatus of claim 11, the partial saturation region being a region of reduced cross-sectional area, compared with other regions of the first layer.

13. The apparatus of claim 12, the first layer including a plurality of partial saturation regions, the plurality of partial saturation regions having lower cross-sectional areas than other regions of the first layer, each of the plurality of partial saturation regions having a lower saturation flux than the other regions of the first layer.

14. An apparatus, the apparatus being an armature for a balanced armature device, the armature having an armature saturation flux at which the armature is completely saturated, the armature including a multi-layer portion including:

a first layer including a partial saturation region, the partial saturation region being saturated by an armature flux level less than the armature saturation flux; and a second layer operational as a flux shunt around the partial saturation region when the partial saturation region is saturated, the partial saturation region being a region of reduced cross-sectional area, compared with other regions of the first layer, the first layer including a plurality of partial saturation regions, the plurality of partial saturation regions having lower cross-sectional areas than other regions of the first layer, each of the plurality of partial saturation regions having a lower saturation flux than the other regions of the first layer, the armature including a plurality of multilayer structures at different positions along the armature.

15. The apparatus of claim 11, the armature being a variable reluctance armature, the armature reluctance being increased by saturation of the partial saturation region.

16. The apparatus of claim 11, the apparatus being an armature for a balanced armature speaker.

17. An apparatus, the apparatus being a magnetic apparatus comprising:

an armature;

a coil, the coil being energizable by a drive signal so as to induce a flux within the armature; and at least one permanent magnet;

the armature having an equilibrium position with no drive signal applied, a portion of the armature being displaceable relative to the equilibrium position by the drive signal so as to have a displacement correlated with a drive signal level up to a saturation flux of the armature, the armature being configured to have an armature reluctance that increases with flux level for flux levels substantially below the saturation flux, so as to obtain a generally linear relationship between the displacement and the drive signal level, the armature comprising a first material and a second material, the first material comprising a partial saturation portion that saturates at lower flux levels than required to saturate proximate portions of the first material, the second material providing a flux shunt around the partial saturation portion when the partial saturation portion is saturated, the flux shunt having a higher reluctance than the partial saturation portion of the first material.

18. The apparatus of claim 17, wherein the armature comprises a first material and a second material, at least a portion of the first material saturating at a flux lower than that required to saturate the second material, the second material providing a flux shunt when the saturation portion is saturated.

19. The apparatus of claim 17, the apparatus comprising first and second permanent magnets, the portion of the armature being displaceable relative to the equilibrium position being an end portion of the armature extending into a gap between the first and second permanent magnets, the apparatus further comprising a magnetic yoke providing a flux pathway between the first and second magnets.

20. The apparatus of claim 17, the apparatus including a permanent magnet, the apparatus further comprising a magnetic yoke providing a flux pathway from the permanent magnet to a gap between portions of the magnetic yoke, the portion of the armature being displaceable relative to the equilibrium position being an end portion of the armature extending into the gap between portions of the magnetic yoke.

21. The apparatus of claim 17, the apparatus being a motor or generator.

* * * * *